US010335824B2

(12) United States Patent
Mueller

(10) Patent No.: US 10,335,824 B2
(45) Date of Patent: Jul. 2, 2019

(54) GLUE APPLICATION ROLLER FOR USE IN A GLUING ASSEMBLY EQUIPPED WITH AT LEAST ONE SCOOPING ROLLER

(71) Applicant: Mueller Martini Holding AG, Hergiswil (CH)

(72) Inventor: Hans Mueller, Lauda-Koenigshofen (DE)

(73) Assignee: MUELLER MARTINI HOLDING AG, Hergiswil (CH)

( * ) Notice: Subject to any disclaimer, the term of this patent is extended or adjusted under 35 U.S.C. 154(b) by 48 days.

(21) Appl. No.: 15/599,494

(22) Filed: May 19, 2017

(65) Prior Publication Data

US 2017/0341101 A1 Nov. 30, 2017

(30) Foreign Application Priority Data

May 26, 2016 (CH) ..... 0676/16

(51) Int. Cl.

| | |
|---|---|
| ***B05C 1/08*** | (2006.01) |
| ***B05C 1/00*** | (2006.01) |
| ***B42C 9/00*** | (2006.01) |
| *B05D 1/28* | (2006.01) |
| *B05D 5/10* | (2006.01) |

(52) U.S. Cl.

CPC ..... *B05C 1/006* (2013.01); *B05C 1/0808* (2013.01); *B42C 9/0012* (2013.01); *B05C 1/0865* (2013.01); *B05D 1/28* (2013.01); *B05D 5/10* (2013.01)

(58) Field of Classification Search

CPC ..... B05C 1/006; B05C 1/0808; B05C 1/0865; B05D 1/28; B05D 5/10; B42C 9/0012; B42C 9/0018; B42C 9/0025; B42C 9/0031; B42C 9/0037

See application file for complete search history.

(56) References Cited

U.S. PATENT DOCUMENTS

| | | | |
|---|---|---|---|
| 4,677,005 | A | 6/1987 | Riesmeier et al. |
| 5,194,116 | A | 3/1993 | Davis et al. |
| 5,988,968 | A | 11/1999 | Hansmeier et al. |
| 2013/0224375 | A1 | 8/2013 | Mueller |

(Continued)

FOREIGN PATENT DOCUMENTS

| | | | |
|---|---|---|---|
| DE | 2855210 | A1 | 7/1980 |
| DE | 3502733 | C1 | 2/1986 |
| DE | 4332069 | A1 | 3/1995 |

(Continued)

*Primary Examiner* — George R Koch

(74) *Attorney, Agent, or Firm* — Leydig, Voit & Mayer, Ltd.

(57) ABSTRACT

A glue application roller for use in a gluing assembly equipped with at least one scooping roller includes a glue roller body that is provided with a central hole to receive a drive shaft. The glue roller body has at least two parts including a base and an outer ring. The base is operatively connected to the drive shaft by a non-positive fit. The outer ring is configured with at least one cavity. The base and the outer ring are coupled to each other non-positively via at least one first means. On at least one side of the glue roller body, there are second means that ensure that compressed air and/or another gaseous or liquid medium is fed into or discharged from the cavity so as to effectuate a change in a circumferential contour of the cavity.

18 Claims, 3 Drawing Sheets

(56) References Cited

U.S. PATENT DOCUMENTS

| | | | |
|---|---|---|---|
| 2013/0230368 | A1 | 9/2013 | Mueller |

FOREIGN PATENT DOCUMENTS

| | | | |
|---|---|---|---|
| DE | 102004037892 | B3 | 11/2005 |
| EP | 0873882 | A1 | 10/1998 |
| EP | 2634007 | B1 | 7/2014 |
| EP | 2634008 | B1 | 7/2014 |

GLUE APPLICATION ROLLER FOR USE IN A GLUING ASSEMBLY EQUIPPED WITH AT LEAST ONE SCOOPING ROLLER

CROSS-REFERENCE TO PRIOR APPLICATION

Priority is claimed to Swiss Patent Application No. CH 00676/16, filed on May 26, 2016, the entire disclosure of which is hereby incorporated by reference herein.

FIELD

The invention relates to a glue application roller for use in a gluing assembly equipped with at least one scooping roller, whereby the glue application roller consists of a glue roller body that is provided with a central hole to receive a drive shaft. Moreover, the invention relates to a method for the operation of a gluing assembly using the glue application roller.

BACKGROUND

During bookbinding, the book blocks that have not yet been provided with a cover are transported by means of a transport device, while an application roller that cooperates with a scooping roller is rolled along the spine of the book block, thereby applying adhesive to the spine.

The contour of the spine of the book block can be straight or else round as well as quasi-round, which is why a correspondingly shaped application roller is used. Prior-art application rollers have, for example, a flat or profiled configuration.

These and similar methods and devices can be found in European patent application EP 0873882 A1, in German patent DE 3502733 C1 or in German patent application DE 4332069 A1.

The prior-art methods and devices call for a manual replacement of the application roller.

Whenever a new production order is received, the bookbinding line has to be brought to a standstill for safety reasons since the application roller can only be removed or installed when the housing is open. Consequently, after adhesive has been applied to the spine of the last book block belonging to the preceding production order, the machine first has to be brought to a standstill. After the housing is opened, the application roller that is currently present is removed and an application roller that is suited for the new production order is installed. In the ideal case, before the application roller that is currently present is removed, the application of glue onto the glue scooping roller is set to almost zero and consequently, the glue film thickness on the application roller is also set to the minimum thickness, so that the application roller can be removed with virtually no dripping. In order to remove the application roller, at least the side scraper, which is installed in the dismantling direction, has to be pivoted out of the way. Then the application roller is manually moved away from the glue scooping roller by means of a positioning unit and removed by hand. Subsequently, the new application roller is slid back onto the drive shaft and locked in place, and then moved towards the scooping roller by means of the positioning unit. Then the one scraper has to be pivoted back in place and both scrapers have to be adjusted to the thickness and diameter of the new glue application roller, and the glue film thickness on the glue scooping roller has to be set manually once again. Once the housing has been closed, the production can be started up again and the new production order can be processed.

The prior-art methods and devices are thus relatively time-consuming and also require manual intervention on the part of the operating personnel. As a result, especially in cases of small print runs, this translates into retooling that requires a relatively long time.

Moreover, European patent specification EP 2634007 B1 discloses a device consisting of at least two application rollers that are spaced axially relative to each other as well as a replacement apparatus for the application rollers. Each of the application rollers is oriented so as to be flush with the scooping roller. The replacement apparatus is configured in such a way that a first application roller that is oriented so as to be flush with the scooping roller can be replaced by a second application roller.

Owing to this configuration of the device and to the corresponding process sequence, the replacement of the application rollers arranged in the device can be carried out without manual intervention and independently of the size of the print run of a given production order.

However, such a solution encounters difficulties if glue residues harden on the disengaged glue application roller, since these glue residues then cause malfunctions during the subsequent use if they are not specifically removed or dissolved beforehand. These malfunctions are no longer so critical in the case of self-dissolving glue residues, if such types of glue are used.

European patent specification EP 2634008 B1 proposes using a certain automatic approach in a gluing assembly in order to switch over from one application roller to another. An installed application roller is dismantled in that, together with its rotating shaft, it is pivoted away from the glue scooping roller by using a pneumatic drive in such a way that this application roller can be swung out without touching the glue scooping roller.

The new application roller can be manually or automatically slid onto the rotating shaft, and then the above-mentioned pneumatic drive can bring this application roller back into position relative to the glue scooping roller. Because of the different round or straight contours of the application rollers, the distance has to be readjusted between the glue scooping roller and the rotating shaft—and thus the application roller.

SUMMARY

In an embodiment, the present invention provides a glue application roller for use in a gluing assembly equipped with at least one scooping roller. The glue application roller includes a glue roller body that is provided with a central hole to receive a drive shaft. The glue roller body has at least two parts including a base and an outer ring. The base is operatively connected to the drive shaft by a non-positive fit. The outer ring is configured with at least one cavity. The base and the outer ring are coupled to each other non-positively via at least one first means. On at least one side of the glue roller body, there are second means that ensure that compressed air and/or another gaseous or liquid medium is fed into or discharged from the cavity so as to effectuate a change in a circumferential contour of the cavity.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
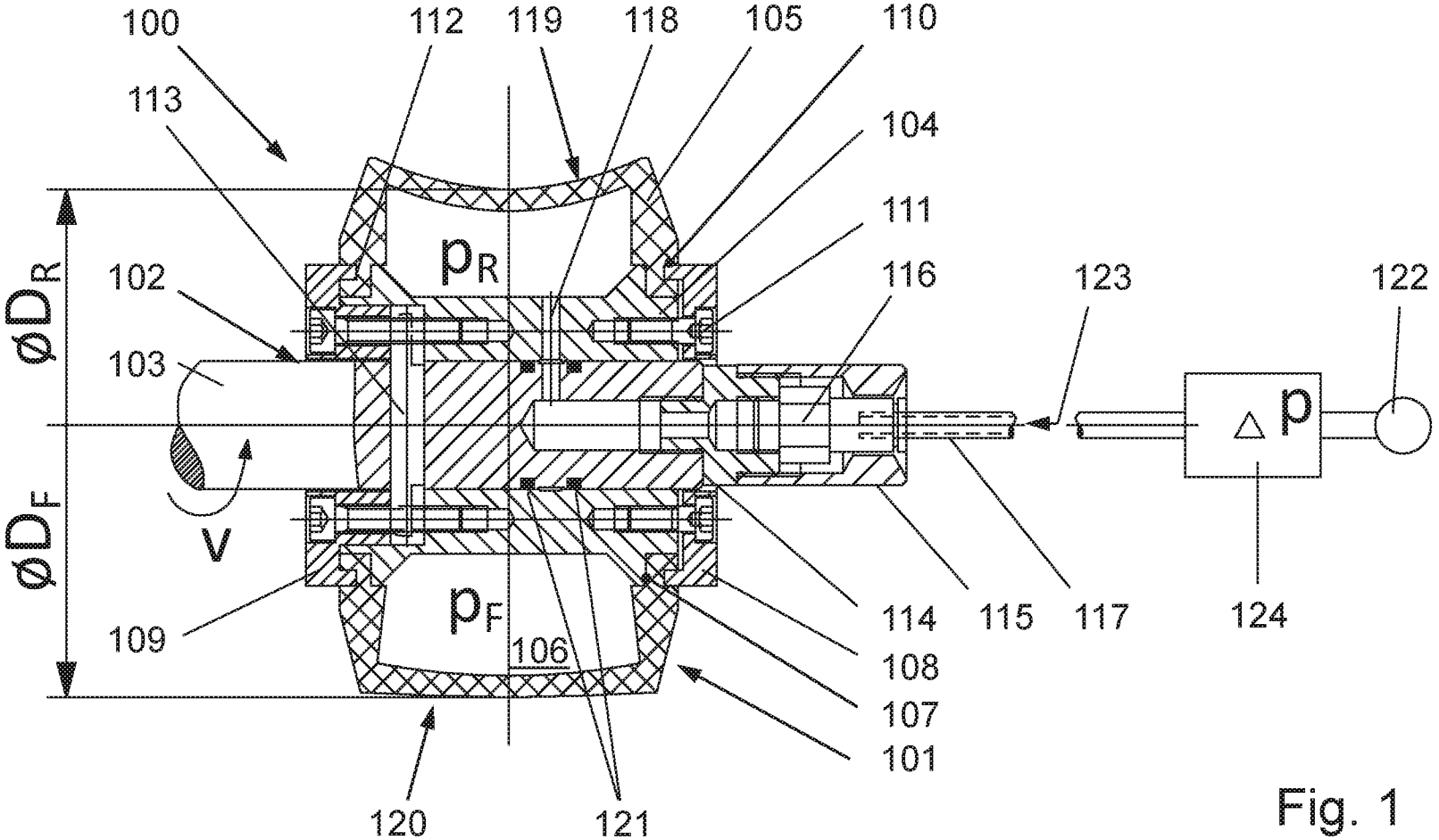
FIG. 1 an assembled glue application roller with a first compressed air feed unit.

In an embodiment, the invention provides a remedy to the entire situation discussed above by a device and a method with which adhesive is transferred by a glue application roller onto the book spine of a book block without any manual intervention. This should be possible independently of the spine shape of the textblockbook block that is to be processed, that is to say, either with a straight and/or a round spine.

In particular, this should be possible within the scope of small print runs with varying spine shapes and especially if only one book is to be produced.

According to an embodiment of the invention, the device has a glue application roller as well as an air feed unit by means of which compressed air is fed into a glue application roller that is configured with a cavity. Instead of using compressed air, it is also fundamentally possible to use another gaseous or liquid medium.

For the sake of simplicity, the term compressed air will be used below, but without intending to exclude the use of the other above-mentioned and operatively conceivable media.

The contour of the round-spine glue roller can be changed into the straight-spine glue roller by increasing the pressure of the compressed air that is fed in. A proportional valve is used to set the pressure in accordance with the desired spine shape, thus rendering it unnecessary to replace a glue roller.

When it comes to the material of the pressure-active cavity portion of the glue application roller, it can be such that the increase in the internal pressure of the round shape (concave in the overall view) all the way to the straight contour does not end but rather can be continued until an upward curved (convex) contour is created, which is used for special textblock spines.

As a result, any glue scrapers that might be used on the outer contour of the glue application roller are not affected by the contour change and they can remain at their place of use.

In general, it applies that the internal pressure ($p_R$) in the glue application roller$_{Round}$ is less than the internal pressure ($p_F$) of the glue application roller$_{Flat}$.

When the convex circumferential contour is created, the internal pressure ($p_F$) of the glue application roller$_{Flat}$ is smaller than the desired internal pressure ($p_C$) of the glue application roller$_{Convex}$.

Below, the main focus will be on the change of a round-spine glue roller contour into a straight-spine glue roller contour: as a result of the change from the round-spine glue roller contour into the straight-spine glue roller contour, the effective diameters of the glue application roller and thus also its circumferential speed are changed. This change is adjusted or controlled by the drive of the gluing assembly as a function of the diameter difference.

For this purpose, according to an embodiment of the invention, the rotational speed of the drive is individually set by a frequency converter. Consequently, via a gear system, a predefined rotational speed is generated on the drive shaft on which the glue application roller is mounted. On the basis of a specially drawn-up table, a given air pressure in the glue application roller is associated with each book block as a function of its thickness and spine shape. Based on the air pressure in the application roller, specially undertaken test series were able to determine the effective diameter of the glue application roller and thus also the concave shape of the glue application roller. The effective diameter describes the apex of the roller contour that is in contact with the apex of the rounding of the book block, for example, in the case of a rounded and compressed book block.

Depending on the production speed of the bookbinding line, the book block is moved underneath the glue application roller at a defined transport speed in the transport direction of the book block. The glue application roller is wetted by the glue scooping roller at a defined glue film thickness and the glue application roller transfers this picked-up glue onto the spine of the book block. During this transfer of the glue, approximately the same speeds should prevail at the contact points of the glue application roller with the spine of the book block. Since the speed of the book block is not dependent on the book block format, but rather, is oriented towards the production speed of the bookbinding line, the speed of the glue application roller has to be adjusted here accordingly in that the rotational speed of the drive shaft is changed.

For this purpose, if all of the embodiments according to the invention are to be encompassed, the effective glue-transferring circumferential surface of the glue application roller has to have a high flexibility relative to the contour of the glue application roller that has to be wetted.

According to an embodiment of the invention, in order to avoid contamination with glue at the head or foot of the book block during the application of glue, the speed of the glue application roller can be increased or decreased in these areas and a pneumatic lifting unit can lift the entire gluing assembly off of the book block.

Improvements can be made by changing the air pressure in the glue application roller so as to avoid contamination with glue at the head or foot of the book block. During the gluing of the book block, the air pressure in the area of the head and/or foot can differ from that in the middle section of the book block. In the case of a single print run, an air pressure that is optimal for this process and that differs from that used for book block gluing can be employed to transfer the glue film from the glue scooping roller to the glue application roller, and then it is possible to switch over to the air pressure that is optimal for this book block when the book block moves past in order to have glued applied onto it.

The height difference between the glue application roller and the spine of the book block resulting from the change in the effective diameter is adjusted as a function of the difference between the radius$_{Round}$ and the radius$_{Flat}$ or vice versa by means of an additional height adjustment mechanism, so that the switch-over from flat spines to round spines takes place automatically.

For this purpose, an automatic height adjustment mechanism is installed on the gluing assembly. With this solution according to an embodiment of the invention, two track rollers, which are installed on the outer points of the axis of rotation of the gluing assembly, move the gluing assembly in the transport direction of the book block as a function of the book block format. The height adjustment mechanism described here is only put forward by way of example. Other solutions are also possible in which a height change from flat to round is carried out by a cylinder with a fixed stroke. The spindle has a handwheel for purposes of fine adjustment and the rocker is turned by a switchable spline.

Via a rocker to which a track roller is attached, the gluing assembly rests on a rigid support. This support is connected to the back-gluing station so that, when the height of the back-gluing station is adjusted, the height of the gluing assembly is automatically adjusted along with it when the entire gluing assembly is turned around its axis of rotation. In this process, the glue application roller executes the same height adjustment as the back-gluing station.

Owing to the automatic height adjustment mechanism according to an embodiment of the invention, it is possible to effectuate different diameters of the glue application roller. A drive serves to drive a spindle that is connected to the rocker via a pivot joint, and it rotates the rocker around its axis of rotation. Since the track roller that is attached to the rocker rests on the support, the height of the axis of rotation of the rocker is adjusted, thereby pivoting the entire gluing assembly around its axis of rotation.

The compressed air can be fed into the glue roller either centrally via a hole in the drive shaft or else via a cap that is installed on the glue application roller. In both cases, compressed air is fed into the rotating glue application roller via a revolving air distributor and it is regulated by means of a proportional valve as a function of the desired contour.

This also has the advantage that this allows the air pressure to be set very precisely. Thus, in these gluing assemblies, a variety of hot glues can be used so that the temperature of the glues during the processing can differ up to a temperature of 100° C. The proportional valve can counter a heating up of the glue application roller, thereby also countering an unwanted pressure increase in the glue application roller, so that a desired pressure can be maintained in a controlled manner.

Of course, as already mentioned above, instead of using compressed air, it is also fundamentally possible to use another gaseous medium that then behaves physically similar to air under the pressure increases that occur.

For this purpose, the glue application roller is configured for use in a gluing assembly equipped with at least one scooping roller. This glue application roller comprises a glue roller body with a central hole to receive a drive shaft.

The glue roller body consists of at least two parts, whereby, on the one hand, it comprises a base that is operatively connected to the drive shaft directly by means of a non-positive fit, and on the other hand, it comprises an outer ring that is configured with at least one cavity. The base and the outer ring are coupled to each other non-positively via at least one means, whereby, on at least one side of the glue roller body, the drive shaft is provided with central or quasi-central means via which compressed air can be fed in or discharged in order to effectuate a contour change of the outer circumference of the cavity of the outer ring of the glue roller body.

Moreover, the gluing assembly is operated making use of the glue application roller, and it entails at least the following main process steps:

i) the rotational speed of a drive motor is individually set by a frequency converter;

ii) via a gear system, a predefined rotational speed is generated on the drive shaft on which the glue application roller is mounted;

iii) depending on the air pressure set in the glue application roller, the effective diameter of the glue application roller and thus also the desired circumferential contour of the glue application roller created by a compressed air feed unit are set, whereby the ideal air pressure was determined ahead of time as a function of the book block thickness and, if applicable, as a function of the round shape (very round or less round), and this air pressure is stored in a table and operatively set according to this table. After all, if the air pressure were always to be only set on the basis of visual contact at the time when the application roller was placed onto the book block and were to be determined in this manner, then the gluing process would not be fully automatic. This leaves the possibility open, of course, that the air pressure can still always be changed during the production;

iv) depending on the production speed of the bookbinding line, the book block is moved underneath the glue application roller at a defined transport speed in the transport direction of the book block;

v) the glue application roller is wetted by the glue application roller at a defined glue film thickness and the glue application roller transfers this picked-up glue onto the spine of the book block;

vi) the speed of the book block is not dependent on the book block format, but rather, is oriented towards the production speed of the bookbinding line, so that the speed of the glue application roller is adjusted accordingly in that the rotational speed of the drive shaft is changed;

vii) the height difference between the glue application roller and the spine of the book block resulting from the change in the effective diameter is adjusted by means of an additional height adjustment mechanism as a function of the difference at least between the $\text{radius}_{Round}$ and the $\text{radius}_{Flat}$ or vice versa, so that the switch-over from flat spines to round spines takes place automatically;

viii) an automatic height adjustment on the gluing assembly is carried out by means of two track rollers, which are installed on the outer points of the axis of rotation of the gluing assembly and which are moved in the transport direction of the book block as a function of the book block format;

ix) via a rocker to which a track roller is attached, the gluing assembly rests on a rigid support in such a way that this support is connected to a back-gluing station so that, when the height of the back-gluing station is adjusted, the height of the gluing assembly is automatically adjusted along with it when the entire gluing assembly is turned around its axis of rotation, whereby the glue application roller executes the same height adjustment as the back-gluing station.

Figure 2:
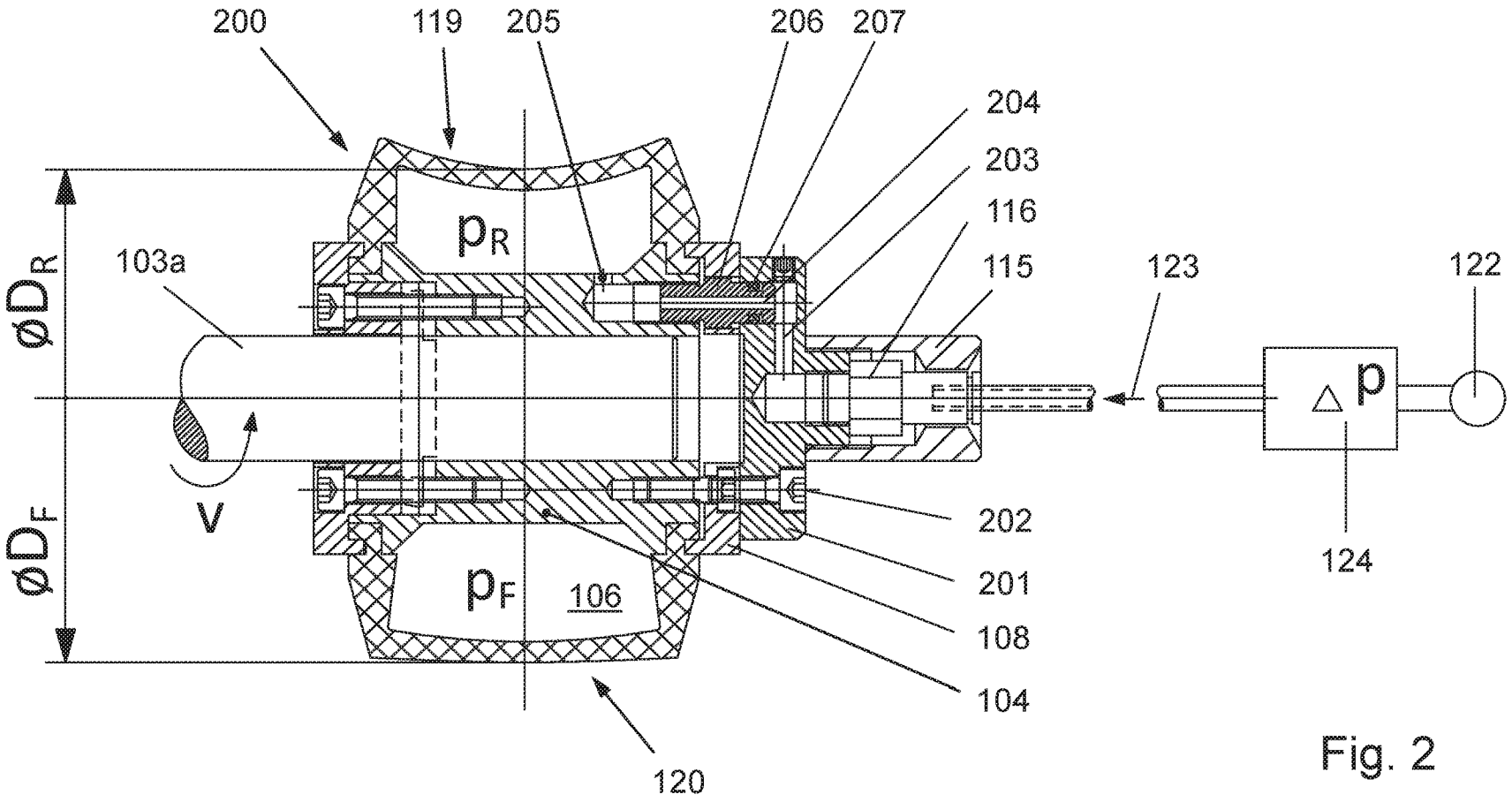
FIG. 2 another assembled glue application roller with a second compressed air feed unit.

FIGS. 1 and 2 show two variants of a completely assembled glue application roller 100, 200 which are operated according to the same principle, that is to say, the outer effective circumferential contour is changed when compressed air is fed into the peripherally arranged cavity of the glue application roller, whereby this cavity forms a single chamber in the circumferential direction.

This cavity, however, can also be augmented by a number of radially positioned membranes that divide the cavity into sectors, whereby these sectors are individually charged with compressed air and are configured so as to be air-tight relative to each other or else, via openings that interact, these sectors form a communicating system over the entire cavity.

FIGS. 1 and 2 are drawn in such a way that the representation shows two halves, each relating to the two conceivable embodiments of the circumferential line, in other words, once for use with round book spines (top) and once for use with flat book spines (bottom). The pressure prevailing in the cavity is designated as $P_{Round}$, that is to say, $P_R$, and as $P_{Flat}$, that is to say, $P_F$, and assuming a starting position $P_{Round}$, it is evident with this constellation, that $P_R<P_F$. The reference numerals pertaining to the radius or diameter are merely of a qualitative nature.

According to FIG. 1, the glue application roller 100 consists of a glue roller body 101 with a central hole 102 to receive a drive shaft 103. The glue roller body comprises two parts: on the one hand, the glue roller body consists of a base 104 made of steel that is operatively connected to the drive shaft, and on the other hand, it consists of an outer ring 105 that is made of an elastic material and that has the above-mentioned cavity 106. The base and the outer ring are preferably non-positively connected via a fitting connection 107. In order for this connection 107 to be designed so as to maximally withstand forces, flanges 108, 109 are provided on both sides of the glue roller body and these flanges are configured to be concentric to the drive shaft and to join the base and the outer ring so as to form an immovable unit. For this purpose, the outer protruding rim 110 of each flange is connected by means of a screwed connection 111 to an encircling groove 112 in the outer ring, ensuring that the glue roller body forms a firm unit. A locking pin 113 non-positively couples the drive shaft to the base of the glue roller body, thus forming a cohesive rotating unit, as is illustrated by item V. On at least one side of the glue roller body, the drive shaft is augmented in the center with an adapter 114 and a protective sleeve 115, whereby the interior of the adapter has a revolving distributor 116 via which compressed air 123 is fed into the interior of the drive shaft. Thus, the primary function of the protective sleeve 115 can be seen as ensuring that the revolving distributor 116 is not damaged. As an alternative, the adapter 114 can be dispensed with and the revolving distributor 116 can be integrated directly into the drive shaft 103. The end of the revolving distributor 116 is coupled to a hose 117 through which compressed air is conveyed. The adapter has a branch for the compressed air and this branch is formed by at least one radially oriented hole 118 that opens up into the cavity 106 of the glue roller body in order to change the volume formed by the cavity in that a pressure differential is generated, as is illustrated by the aggregate 122 that supplies the compressed air and that has the adjoining proportional valve 124.

This pressure differential changes an outer round contour 119 of the glue roller body into a flat contour 120, as a result of which both book block spine shapes (round/flat) can be processed alternately, which can be done without replacing the glue roller bodies. The same approach in the reverse order also applies when pressure in the glue roller body has to be relieved so that the circumferential flat contour 120 of the glue roller body can be changed back into the (original) circumferential round contour. Gaskets 121 arranged on both sides ensure proper sealing of the transition of the hole 118 that conveys compressed air and that extends in the radial direction between the outer circumference of the drive shaft and the inner circumference of the base of the glue roller body.

FIG. 2 corresponds essentially to FIG. 1, whereby the differences from FIG. 1 are indicated by items designated with numbers in the 200 series. Between the flange 108 and the protective sleeve 115, which are similar to those of FIG. 1, this glue application roller 200 has a cap 201 that is screwed 202 in-between and that is operatively connected to the revolving distributor 116, whereby inside this cap 201, there is at least one radially oriented hole 203 which conveys compressed air and whose layout is such that it makes a transition at the height of the flange 108 into at least one axially or quasi-axially oriented hole 204 that extends all the way into the base 104. At the height of the cavity 106, at least one more likewise radially or quasi-radially oriented hole 205 branches off from the axially or quasi-axially oriented hole 204, and compressed air 123 is fed into the cavity 106 via said hole 205.

This axially or quasi-axially oriented hole 204 passes through a bolt 206 which serves as a connection between the cap 201 and the base 104, and the bolt 206 that is screwed into the base 104 is sealed off vis-à-vis the cap 201 by means of a gasket 207.

Accordingly, in FIG. 2 as well as in FIG. 1, a compressed air feed unit is selected that is regulated in terms of the air feed, the pressure build-up and the pressure relief, that is to say, the compressed air 123 is fed into the rotating glue application roller and regulated in accordance with the desired contour, preferably by means of a proportional valve 124.

This is thus an embodiment variant in which the air is fed into the cavity 106, without involving the drive shaft 103*a*.

In summary, it can be said that the compressed air is fed into the glue roller either centrally via a hole in the drive shaft (see FIG. 1) or else via an installed cap in accordance with FIG. 2. In both cases, a revolving air distributor feeds compressed air into the rotating glue application roller and it is regulated as a function of the desired contour by means of a proportional valve.

Consequently, it can be seen from the description of FIGS. 1 and 2 that the structure of the embodiment variant of FIG. 2 has the advantage over that of FIG. 1 that, in this case, the glue application roller can be changed quickly as needed, since the energy supply, here the feed unit for compressed air or for another gaseous or liquid medium, is part of the glue roller body 101. Thus, the embodiment variant according to FIG. 2 can easily be implemented in existing hollow rollers in such a way that, at most, only the receiving hole has to be modified accordingly. Therefore, with this embodiment variant according to FIG. 2, it is easy to retrofit existing glue application rollers. In any case, in the embodiment variant according to FIG. 2, the drive shaft neither has to be replaced nor modified, which is the case with the above-mentioned variant according to FIG. 1.

By changing the round-spine contour into the straight-spine contour, the effective diameter of the glue application roller and thus also its rotational speed change. This change is adjusted or regulated accordingly by the drive of the gluing assembly 300 as a function of the diameter difference.

Figure 3:
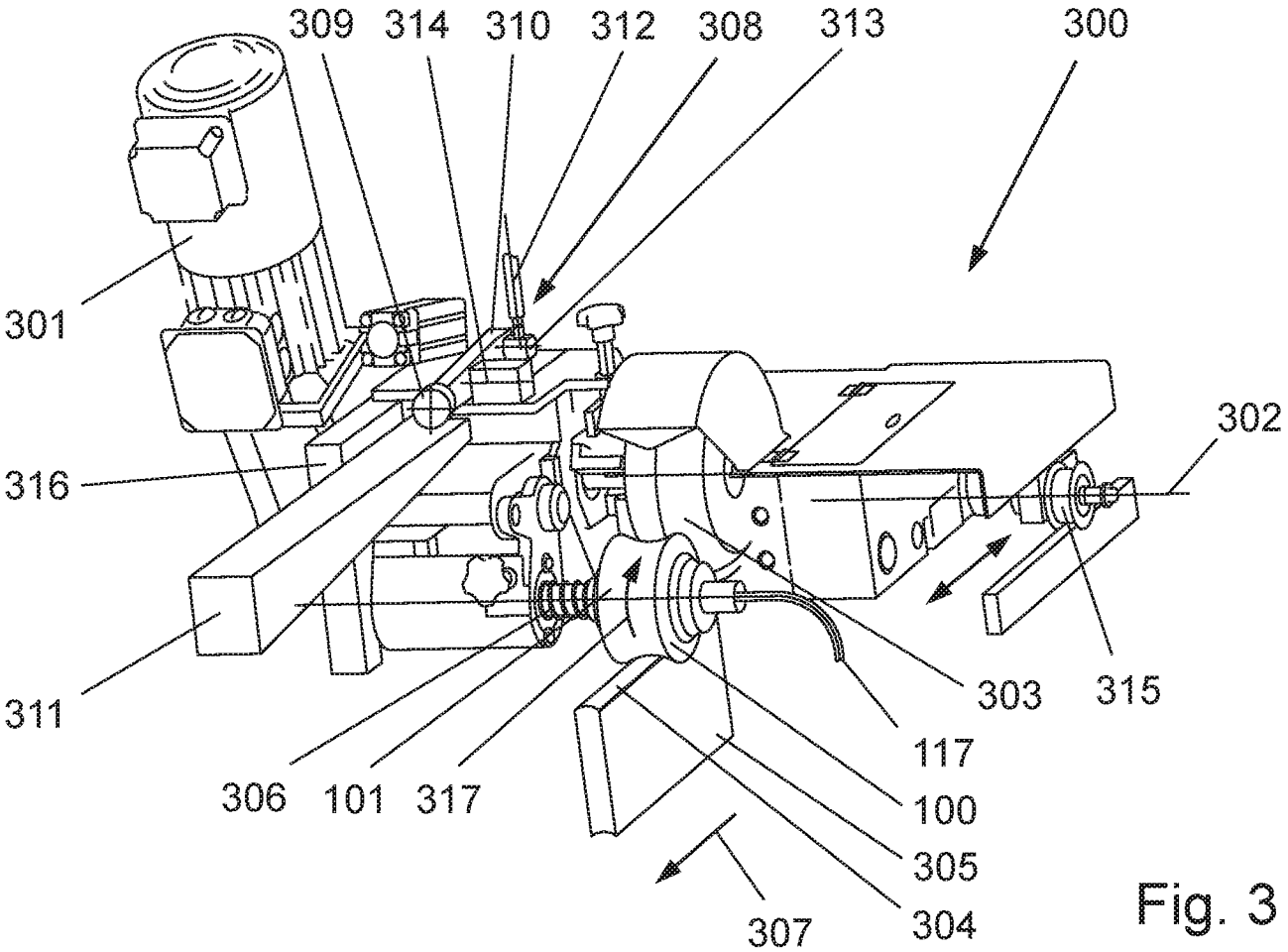
FIG. 3 a gluing assembly that has been dismantled in its entirety and that uses a glue application roller according to FIG. 1 or 2.

For this purpose, according to FIG. 3, the rotational speed of the drive motor 301 is individually set by a frequency converter. Consequently, via a gear system 316, a predefined rotational speed 317 is generated on the drive shaft 306 on which the glue application roller 100 (or else 200, see FIG. 2) is mounted. On the basis of a specially drawn-up table, an air pressure in the glue application roller is associated with each book block as a function of its block thickness and spine shape. The effective diameter of the glue application roller and thus also the concave shape of the glue application roller were ascertained on the basis of the air pressure in the employed glue application roller. The effective diameter describes the apex of the roller contour that is in contact with the apex of the rounding of the book block, for example, in the case of a rounded and compressed book block. Depending on the production speed of the bookbinding line, the book block is moved underneath the glue application roller at a defined transport speed in the transport direction of the book block. The glue application roller is wetted by the glue scooping roller 303 at a defined glue film thickness and the glue application roller transfers this picked-up glue onto the spine 304 of the book block. During this transfer of the glue, approximately the same speeds should prevail at the contact points of the glue application roller with the spine of the book block.

Since the speed of the book block 305 is not dependent on the book block format, but rather, it is based on the production speed of the bookbinding line, the speed of the glue application roller has to be adjusted accordingly here by changing the rotational speed of the drive shaft 306. In order to avoid contamination with glue at the head or foot of the book block during the application of glue, the speed of the glue application roller can be increased or decreased in these areas and a pneumatic lifting unit can lift the entire gluing assembly off of the book block. Of course, improvements can be made by changing the air pressure in the glue application roller so as to avoid contamination with glue at the head or foot of the book block. Thus, during the gluing of the book block, the air pressure in the area of the head and/or foot can differ from that in the middle section of the book block. In the case of a single print run, an air pressure that is optimal for this process and that differs from that used for book block gluing can be employed to transfer the glue film from the glue scooping roller 303 to the glue application roller, and then it is possible to switch over to the air pressure that is optimal for this book block when the book block moves past (see item 307) in order to be glued.

The height difference between the glue application roller and the spine of the book block resulting from the change in the effective diameter is adjusted as a function of the difference between the $\text{radius}_{Round}$ and the $\text{radius}_{Flat}$ or vice versa, so that the switch-over from flat spines to round spines takes place automatically.

For this purpose, according to FIG. 3, an automatic height adjustment mechanism 308 is installed on the gluing assembly. With the solution shown here, two track rollers 315, which are installed on the outer points of the axis of rotation of the gluing assembly, move the gluing assembly in the transport direction of the book block as a function of the book block format. Only one track roller 315 is shown here. Via a rocker 310 to which a track roller 309 is attached, the gluing assembly rests on a rigid support 311. This support is connected to the back-gluing station so that, when the height of the back-gluing station is adjusted, the height of the gluing assembly is automatically adjusted along with it when the entire gluing assembly is turned around its axis of rotation 302. In this process, the glue application roller executes the same height adjustment as the back-gluing station.

Owing to the automatic height adjustment mechanism 308, it is possible to operate with different diameters of the glue application roller. A drive motor serves to drive a spindle 312 that is connected to the rocker 310 via a pivot joint 313, and it rotates the rocker around its axis of rotation. Since the track roller 309, which is attached to the rocker, rests on the support 311, the height of the axis of rotation of the rocker is adjusted, thereby pivoting the entire gluing assembly around the axis of rotation. The arrow 317 drawn on the glue application body 101 designates the rotational speed of the total rotational speed prescribed by the drive shaft 306.

This also has the advantage that this allows the air pressure to be set very precisely. Thus, in these gluing assemblies, a variety of hot glues can be used so that the temperature of the glues during the processing can differ up to a temperature of 100° C. The proportional valve can counter a heating up of the glue application roller, thereby also countering any unwanted pressure increase in the glue application roller, so that a desired pressure can be maintained in a controlled manner.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

What is claimed is:

1. A glue application roller for use in a gluing assembly equipped with at least one scooping roller, the glue application roller comprising:

a glue roller body that is provided with a central hole to receive a drive shaft, the glue roller body having at least two parts including:

a base that is operatively connected to the drive shaft by a non-positive fit, and an outer ring that is configured with at least one cavity, the base and the outer ring being coupled to each other by at least one force-locking connection, wherein, on at least one side of the glue roller body, there are flow-conduits that ensure that compressed air and/or another gaseous or liquid medium is fed into or discharged from the cavity so as to effectuate a change in a circumferential contour of the cavity.

2. The glue application roller according to claim 1, wherein the glue roller body has, as at least one of the flow-conduits, a directly or indirectly connected revolving flow-distributor from which the compressed air and/or another medium, while bypassing the drive shaft, is conveyable through the glue roller body via a contiguous flow conduit, and wherein the compressed air and/or another medium are subsequently operatively connected to the cavity.

3. The glue application roller according to claim 1, wherein the drive shaft downstream from the glue roller body has, as at least one of the flow-conduits, at least one centrally or quasi-centrally arranged revolving flow-distributor from which the fed-in compressed air and/or another medium are conveyed by the drive shaft, and wherein the compressed air and/or another medium are subsequently operatively connected with the cavity.

4. The glue application roller according to claim 1, wherein the glue roller body or the drive shaft has, as at least one of the flow-conduits, a revolving flow-distributor operatively connected to at least one valve that regulates the feeding or discharging of the compressed air and/or another medium relative to the cavity located downstream.

5. The glue application roller according to claim 4, wherein the at least one valve is a proportional valve.

6. The glue application roller according to claim 1, wherein the flow-conduits include a revolving distributor that is provided with a protective sleeve.

7. The glue application roller according to claim 1, wherein the base is made of a steel material and the outer ring is made of a volume-flexible material.

8. The glue application roller according to claim 1, wherein the at least one force-locking connection comprises a fitting connection and/or flanges that are installed on flanks of the glue roller body.

9. The glue application roller according to claim 1, wherein the drive shaft is firmly anchored at least to the base by at least one locking pin.

10. The glue application roller according to claim 1, wherein, starting from a concave circumferential contour of the outer ring, which is configured to process a round or quasi-round book block spine, the compressed air and/or another medium is conveyable into the cavity until the circumferential contour is changed into a flat or quasi-flat shape for processing of a correspondingly shaped book block spine.

11. The glue application roller according to claim 1, wherein, starting from a flat circumferential contour of the outer ring that serves for processing of a flat book block spine, the compressed air and/or another medium is continuously conveyable into the cavity until the circumferential contour has a convex shape for processing of a correspondingly shaped book block spine.

12. The glue application roller according to claim 1, wherein the return of the fed-in compressed air and/or of another medium from the cavity from a higher to a lower pressure is configured to be effectuated by an emptying procedure.

13. The glue application roller according to claim 1, wherein the cavity forms a single pressure-active chamber in the circumferential direction.

14. The glue application roller according to claim 1, wherein the cavity is divided by at least one radially positioned membrane which spans the width of the cavity and which, in the circumferential direction, creates at least two sectors inside the cavity, whereby the sectors are sealed air-tight relative to each other and are chargeable by an individual feed of the compressed air and/or another medium.

15. The glue application roller according to claim 1, wherein the cavity has several sectors in the circumferential direction that, among themselves, form a communicating system for the compressed air and/or another medium.

16. A method for operation of a gluing assembly using the glue application roller according to claim 1, the method comprising:

a) individually setting a rotational speed of a drive motor by a frequency converter;

b) generating, via a gear system, a predefined rotational speed on the drive shaft on which the glue application roller is mounted;

c) using, based on a previously drawn-up table, air pressure to set an ideal effective diameter of the glue application roller and, consequently, a desired circumferential contour of the glue application roller by the feed of the compressed air and/or another medium;

d) depending on a production speed of a bookbinding line, moving a book block underneath the glue application roller at a defined speed in a transport direction of the book block;

e) wetting the glue application roller by the at least one scooping roller at a defined glue film thickness and transferring, by the glue application roller, transfers the picked-up glue onto a spine of the book block;

f) adjusting the speed of the glue application roller, wherein the speed of the book block is unrelated to a book block format and depends on the production speed of the bookbinding line, so that the speed of the glue application roller is adjusted accordingly in that the rotational speed of the drive shaft is changed;

g) adjusting a height difference between the glue application roller and the spine of the book block resulting from a change in effective diameter as a function of a difference at least between a first $\text{radius}_{Round}$ and a second $\text{radius}_{Flat}$, or vice versa, by an additional height adjustment mechanism, so that a switch-over from flat spines to round spines takes place automatically;

h) moving two track rollers of an automatic height adjustment mechanism on the gluing assembly in the transport direction of the book block as a function of the book block format, the two track rollers being installed on outer points of an axis of rotation of the gluing assembly; and i) via a rocker to which a track roller is attached, the gluing assembly rests on a rigid support in such a way that the support is connected to a back-gluing station so that adjusting a height of the back-gluing station is adjusted results in a height of the gluing assembly being automatically adjusted along with the back-gluing station, the entire gluing assembly being turned around an axis of rotation, whereby the glue application roller executes a same height adjustment as the back-gluing station.

17. The method according to claim 16, further comprising increasing or decreasing the speed of the glue application roller at a head or foot of the book block so as to avoid contamination with glue at the head or foot of the book block during the application of the glue, wherein a pneumatic lifting unit lifts the gluing assembly entirely off of the book block.

18. The method according to claim 16, further comprising adjusting the air pressure in the glue application roller so as to avoid contamination with glue at a head or foot of the book block during the application of glue.

* * * * *